US010718216B2

(12) United States Patent
Rockarts et al.

(10) Patent No.: US 10,718,216 B2
(45) **Date of Patent: *Jul. 21, 2020**

(54) AIRFOIL FOR GAS TURBINE ENGINE

(71) Applicant: PRATT & WHITNEY CANADA CORP., Longueuil (CA)

(72) Inventors: Sean Rockarts, Mississauga (CA); Peter Townsend, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 261 days.

This patent is subject to a terminal disclaimer.

(21) Appl. No.: 16/117,173

(22) Filed: Aug. 30, 2018

(65) Prior Publication Data

US 2020/0024953 A1 Jan. 23, 2020

Related U.S. Application Data

(63) Continuation of application No. 13/414,950, filed on Mar. 8, 2012, now Pat. No. 10,087,764.

(51) Int. Cl.
*F01D 5/14* (2006.01)
*F01D 5/20* (2006.01)

(52) U.S. Cl.
CPC ..... *F01D 5/141* (2013.01); *F01D 5/20* (2013.01); *F05D 2240/305* (2013.01); *F05D 2240/306* (2013.01)

(58) Field of Classification Search
CPC ..... F01D 5/00; F01D 5/12; F01D 5/14; F01D 5/141; F01D 5/145; F01D 5/20; F01D 5/22
USPC ..... 415/191; 416/223 R, 228, 235, 237, 238, 416/223 A
See application file for complete search history.

(56) References Cited

U.S. PATENT DOCUMENTS

| | | | |
|---|---|---|---|
| 2,068,792 | A | 1/1937 | Dekker |
| 2,426,742 | A | 9/1947 | Pawlowski |
| 3,294,315 | A | 12/1966 | Stewart et al. |
| 4,265,596 | A | 5/1981 | Katagiri et al. |
| 5,064,346 | A | 11/1991 | Atarashi et al. |
| 5,181,830 | A | 1/1993 | Chou |

(Continued)

FOREIGN PATENT DOCUMENTS

| | | |
|---|---|---|
| CN | 201180564 | 1/2009 |

OTHER PUBLICATIONS

Canadian Office Action for corresponding Application No. 2,827,566, dated Jun. 17, 2019.

*Primary Examiner* — Woody A Lee, Jr.
*Assistant Examiner* — Michael L Sehn
(74) *Attorney, Agent, or Firm* — Norton Rose Fulbright Canada LLP

(57) ABSTRACT

An airfoil for a gas turbine engine including a tip extension disposed at the tip of the airfoil body. The tip extension extends from the suction side surface and/or the pressure side surface and defines a tip thickness that is larger than a true thickness of the airfoil body. The true thickness is defined within a plane perpendicular to a root axis and extending transversely to the airfoil chord around a midpoint thereof. The tip extension includes a side transitional surface forming a curve extending tangentially from the side surface and/or the pressure side surface. The tip thickness increases over a radial dimension in the plane that is at least 2 times the true thickness.

20 Claims, 4 Drawing Sheets

(56) References Cited

U.S. PATENT DOCUMENTS

| | | | | |
|---|---|---|---|---|
| 6,024,537 | A | 2/2000 | Moreau et al. | |
| 6,142,739 | A * | 11/2000 | Harvey | F01D 5/20 415/173.1 |
| 6,318,960 | B1 | 11/2001 | Kuwabara et al. | |
| 6,318,961 | B1 | 11/2001 | Phillipsen | |
| 6,626,640 | B2 | 9/2003 | Ivanovic | |
| 6,648,598 | B2 | 11/2003 | Mimura | |
| 6,779,979 | B1 | 8/2004 | Wadia et al. | |
| 7,118,329 | B2 * | 10/2006 | Goodman | F01D 5/20 415/173.1 |
| 7,147,426 | B2 | 12/2006 | LeBlanc et al. | |
| 7,270,519 | B2 | 9/2007 | Wadia et al. | |
| 7,281,894 | B2 | 10/2007 | Lee et al. | |
| 7,438,522 | B2 | 10/2008 | Eimer | |
| 7,837,446 | B2 | 11/2010 | McMillan | |
| 10,087,764 | B2 * | 10/2018 | Rockarts | F01D 5/141 |
| 2009/0136347 | A1 | 5/2009 | Brittingham et al. | |
| 2010/0098554 | A1 | 4/2010 | Cheong et al. | |
| 2010/0221122 | A1 * | 9/2010 | Klasing | F01D 5/20 416/97 R |
| 2011/0255986 | A1 | 10/2011 | Diamond et al. | |

* cited by examiner

AIRFOIL FOR GAS TURBINE ENGINE

CROSS-REFERENCE TO RELATED APPLICATION

The present application is a continuation of U.S. patent application Ser. No. 13/414,950 filed Mar. 8, 2012, the entire content of which is incorporated herein by reference.

TECHNICAL FIELD

The present disclosure relates generally to gas turbine engines, and more particularly to airfoils therefor.

BACKGROUND

Axial compressor blades in a gas turbine engine are typically arranged in an annular array to rotate within the gas path bounded by an outer shroud and an inner platform. The surface defined by the rotating blade tip and the adjacent shroud surface are closely matched, preferably with a minimal gap. Leakage between the blade tips and the shroud may result in a reduced efficiency for the compressor. Further, the passage of the blade tip relative to the shroud usually results in the formation of vortices which may reduce compressor efficiency due to the turbulent air flow.

Compressor blades are relatively thin structures that are subjected to forces due to the air flow over the blade surfaces and due to engine vibration. The configuration of the material mass in a blade results in fundamental vibratory modes. When the frequency of oscillations in load application during engine operation equals one of the blade's fundamental vibratory modes, higher stresses are experienced by the blade.

Since turbine engines intake air that can contain foreign objects, such as birds, blades must be capable of withstanding impact from foreign objects that can be ingested into the engine.

SUMMARY

There is accordingly provided an airfoil for a gas turbine engine, the airfoil comprising: an airfoil body having a suction side surface and a pressure side surface extending between a root and a tip, and a chord defined between a leading edge and a trailing edge, and a radial direction being defined from the root to the tip, the root defining a root axis extending axially therethrough and a plane perpendicular to the root axis; and a tip extension disposed at the tip of the airfoil body, the tip extension extending from one or both of the suction side surface and the pressure side surface and defining a tip thickness that is larger than a true thickness of the airfoil body, the true thickness defined within said plane and extending transversely to the chord around a midpoint thereof, the true thickness measured radially inward of the tip extension, the tip extension including a side transitional surface forming a curve extending tangentially from said one or both of the suction side surface and the pressure side surface, the tip thickness increasing over a radial dimension in said plane that is at least 2 times the true thickness.

There is also provided a rotor for an axial compressor of a gas turbine engine, comprising: a hub adapted to be mounted to a shaft for rotation about a longitudinal axis of the gas turbine engine; and a plurality of blades connected to the hub and projecting radially therefrom, each of the blades having: an airfoil portion extending radially outward from the hub to a tip, the airfoil having a leading edge, a trailing edge, and a chord defined between the leading edge and the trailing edge, the airfoil defining a suction side surface on one side thereof and a pressure side surface on another, and a radial direction being defined from the hub to the tip, the hub defining a hub axis extending axially therethrough and a plane perpendicular to the hub axis; and a tip extension extending from the suction side surface and/or the pressure side surface adjacent the tip and defining a thickness at the tip larger than a true thickness of the airfoil, the true thickness lying in the plane and being defined transversely to the chord around a midpoint thereof and between the hub and the tip extension, the tip extension including a side transitional surface substantially defined along a curve extending tangentially from the suction side surface and/or the pressure side surface, the tip extension increasing in thickness over a portion of the airfoil having a radial dimension greater than or equal to 2 times the true thickness, the radial dimension lying in the plane.

There is further provided a gas turbine engine comprising a compressor section, a combustor, and a turbine section, a rotor of one or both of the compressor section and the turbine section including: a hub mounted to a shaft for rotation about a longitudinal axis of the gas turbine engine; and a plurality of blades connected to the hub and projecting radially therefrom, each of the blades having: an airfoil portion extending radially outward from the hub to a tip, the airfoil having a leading edge, a trailing edge, and a chord defined between the leading edge and the trailing edge, the airfoil defining a suction side surface on one side thereof and a pressure side surface on another, wherein a radial direction is defined from the hub to the tip, the hub defining a hub axis and a plane perpendicular to the hub axis; and a tip extension extending from the suction side surface and/or the pressure side surface adjacent the tip, the tip extension having a tip thickness greater than a true thickness of the airfoil measured in the plane and transverse to the chord around a midpoint thereof, the true thickness defined radially inward of the tip extension, the tip extension including a side transitional surface substantially defined along a curve extending tangentially from the suction side surface and/or the pressure side surface, the tip thickness increasing over a portion of the airfoil having a radial dimension that is greater than or equal to 2 times the true thickness, the radial dimension lying the plane.

In accordance with another aspect, there is also provided an airfoil for a rotor blade or a stator vane of a gas turbine engine, the airfoil comprising: a suction side surface and a pressure side surface extending between a root and a tip, the side surfaces being interconnected by opposed leading and trailing edges with a chord being defined between the leading edge and the trailing edge and a radial direction being defined from the root to the tip; a tip extension extending from at least one of the suction side surface and the pressure side surface adjacent the tip and defining a thickness at the tip larger than a true thickness of the airfoil, the true thickness being defined transversely to the chord around a midpoint thereof and between the root and the tip extension; and the tip extension including a side transitional surface substantially defined along a curve extending tangentially from the at least one of the suction side surface and the pressure side surface, the tip extension defining a gradual increase in the thickness over a portion of the airfoil having a radial dimension corresponding to at least 2 times the true thickness.

In accordance with another aspect, there is also provided a rotor for an axial compressor of a gas turbine engine, comprising: a hub adapted to be mounted to a shaft for rotation about a longitudinal axis of the gas turbine engine; and a plurality of blades connected to the hub and projecting radially therefrom, each of the blades having an airfoil portion extending radially outward from the hub to a tip, the airfoil having a leading edge, a trailing edge, and a chord defined between the leading edge and the trailing edge, the airfoil defining a suction side surface on one side thereof and a pressure side surface on another and a radial direction being defined from the root to the tip, a tip extension extending from at least one of the suction side surface and the pressure side surface adjacent the tip and defining a thickness at the tip larger than a true thickness of the airfoil, the true thickness being defined transversely to the chord around a midpoint thereof and between the root and the tip extension, and the tip extension including a side transitional surface substantially defined along a curve extending tangentially from the at least one of the suction side surface and the pressure side surface, the tip extension defining a gradual increase in the thickness over a portion of the airfoil having a radial dimension corresponding to at least 2 times the true thickness.

In accordance with a further aspect, there is provided a gas turbine engine comprising a compressor section, a combustor and a turbine section, at least one of the compressor section and the turbine section having a rotor, the rotor including: a hub mounted to a shaft for rotation about a longitudinal axis of the gas turbine engine; and a plurality of blades connected to the hub and projecting radially therefrom, each of the blades having an airfoil portion extending radially outward from the hub to a tip, the airfoil having a leading edge, a trailing edge, and a chord defined between the leading edge and the trailing edge, the airfoil defining a suction side surface on one side thereof and a pressure side surface on another, and a radial direction being defined from the root to the tip, a tip extension extending from at least one of the suction side surface and the pressure side surface adjacent the tip and defining a thickness at the tip larger than a true thickness of the airfoil, the true thickness being defined transversely to the chord around a midpoint thereof and between the root and the tip extension, and the tip extension including a side transitional surface substantially defined along a curve extending tangentially from the at least one of the suction side surface and the pressure side surface, the tip extension defining a gradual increase in the thickness over a portion of the airfoil having a radial dimension corresponding to at least 2 times the true thickness.

DESCRIPTION OF THE DRAWINGS

Reference is now made to the accompanying figures in which.

DETAILED DESCRIPTION

Figure 1:
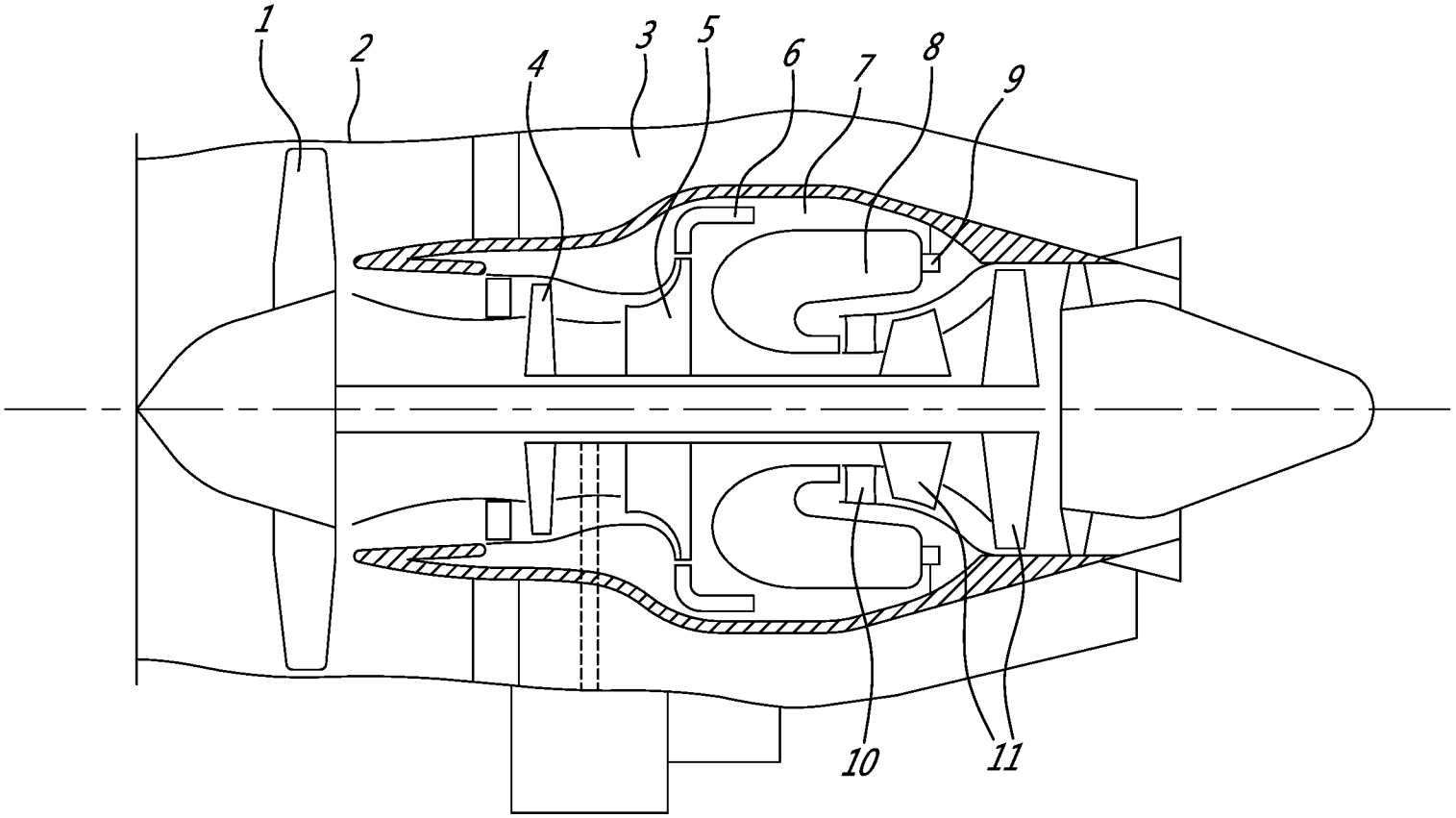
FIG. 1 is a schematic cross-sectional view of a gas turbine engine.

FIG. 1 illustrates a gas turbine engine of a type preferably provided for use in subsonic flight, generally comprising in serial flow communication a fan through which ambient air is propelled, a compressor section for pressurizing the air, a combustor in which the compressed air is mixed with fuel and ignited for generating an annular stream of hot combustion gases, and a turbine section for extracting energy from the combustion gases. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes and fuel is mixed with air from the plenum 7 when sprayed through nozzles 9 into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor 8 and pass over the nozzle guide vane 10 and turbines 11 before exiting the tail of the engine as exhaust.

However, it will be understood that the present invention is equally applicable to any type of gas turbine engine with a combustor and turbine section, including but not limited to a turbo-shaft, a turbo-prop, or auxiliary power units.

Figure 2:
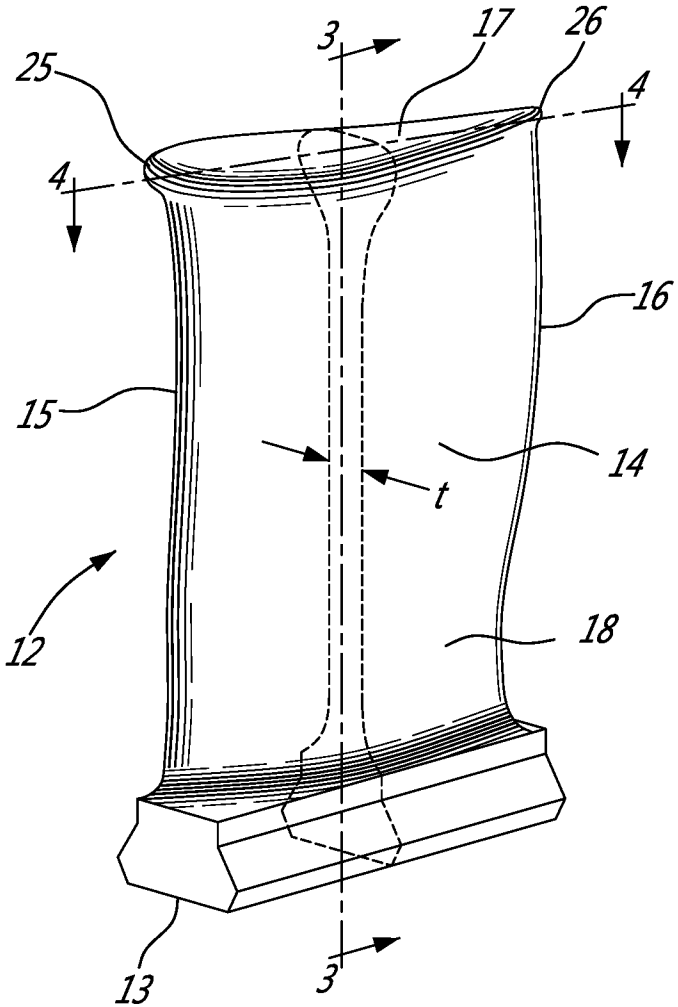
FIG. 2 is a fore-side perspective view of a compressor blade with tip extensions in accordance with a particular embodiment.

FIG. 2 shows an axial compressor blade 12 in accordance with a particular embodiment, disposed for rotation about the engine axis. The rotor blade 12 includes a radially inner blade root 13 that engages an axial slot in a compressor rotor hub. The blade 12 has an airfoil 14 extending radially outward from the blade root 13 and having a leading edge 15, a trailing edge 16, a chord defined between the leading edge and the trailing edge, and a tip 17.

Although the blade and hub are shown as being separate elements, in another embodiment the blade 12 is part of an integrally bladed rotor, i.e. the blades and rotor are formed as a single piece.

Figure 4:
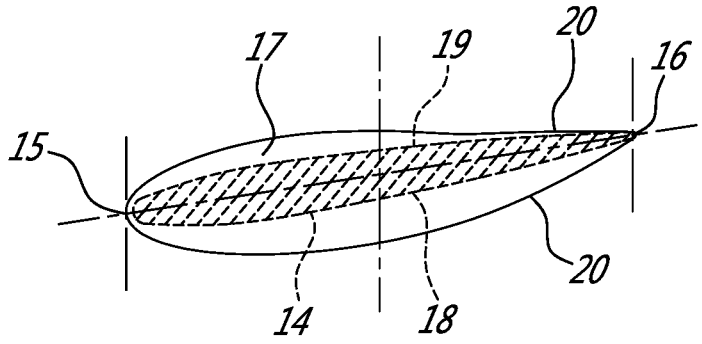
FIG. 4 is a view along line 4-4 of FIG. 2.

The tip 17 of the blade 12 has tip extensions 20 on one or both sides thereof (both sides in the embodiment of FIG. 2), i.e. on one or both of the pressure side and suction side of the airfoil. These tip extensions are tangentially extending portions of the airfoil near or at the tip, such as to create an at least partial thickening of the airfoil tip 17. In a particular embodiment, the tip extensions 20 are part of a monolithic blade 12, i.e. they form a continuous portion of the blade 12. Such tip extensions protrude outwardly at the tip 17 to help reduce tip leakage, such as to improve the efficiency of the axial compressor; the tip extensions may also cause the airfoil 14 to perform like a larger airfoil. As such, the addition of the present blades 12 to existing engines may allow for a higher flow rate through the gas path. As shown in FIG. 4, in this embodiment each of the suction side surface 18 and the pressure side surface 19 of the airfoil 14 includes a tip extension 20 adjacent the tip 17, and the tip extensions 20 extend over the full length of the chord of the airfoil 14.

Figure 3:
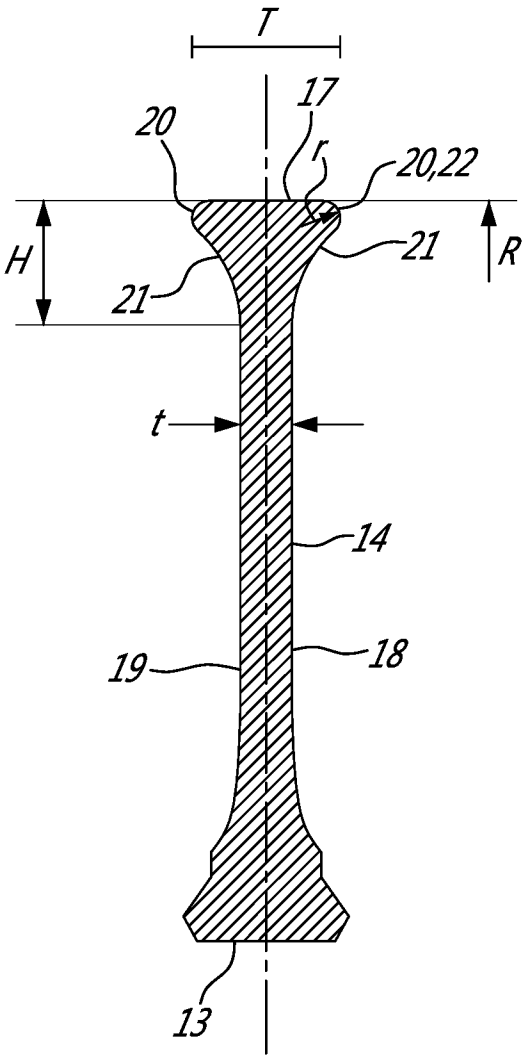
FIG. 3 is a cross-sectional view along line 3-3 of FIG. 2.

Referring to FIGS. 2-3, each tip extension 20 includes a side transitional surface 21 that merges with the corresponding suction side surface or pressure side surface of the airfoil 14. FIG. 3 is oriented and defined such that the section shows the true thickness t of the blade, defined at or approximately mid-chord, and near the tip but below the side transitional surface 21. The gradual thickening of the tip defined by the tip extension 20 extends over a portion of the blade having a radial dimension H. In a particular embodiment, the radial dimension H corresponds to at least 2 times the true thickness t; in another embodiment, the radial dimension H corresponds to from 2 to 5 times the true thickness t.

The side transitional surface 21 may be substantially defined along a curve extending tangentially with the surface of the airfoil 14 and corresponding to an arc of a circle (i.e. defined by a radius) or a quadratic or higher order equation. As used herein, "substantially defined" is intended to include both a curve exactly corresponding to and approximately corresponding to the arc of a circle or the quadratic or higher order equation. For example, the curve can be obtained by defining a plurality of points and using adequate drawing software to define the curve (arc of a circle, quadratic equation, higher order equation, or approximation thereof) closest to these points. The complete side transitional surface 21 is produced by a "sweep" of the curve of FIG. 3 between the trailing and leading edges 15, 16, blended as necessary with the other features of the blade 14. The side transitional surface 21 may have a different profile at different chord positions of the blade 14.

The tip extensions 20 increase the thickness T of the tip 17. In a particular embodiment, the thickness T has a value of from 2 to 4 times the value of t; in a further embodiment, the thickness T has a value of approximately 3 times the value of t. Other relative dimensions are also possible.

In the embodiment shown, each tip extension 20 also includes a tip transitional surface 22 between the tip 17 and the side transitional surface 21, to merge the side transitional surface 21 with the tip 17. The tip transitional surface 22 in the plane of FIG. 3 may be substantially defined by a curve extending tangentially to the side transitional surface 21 and corresponding to an arc of a circle (as shown here with radius r) or a quadratic or higher order equation. For example, the curve can be obtained by defining a plurality of points and using adequate drawing software to define the curve (arc of a circle, quadratic equation, higher order equation, or approximation thereof) closest to these points. The complete tip transitional surface 22 is produced by a "sweep" of the curve of FIG. 3 between the trailing and leading edges 15, 16, blended as necessary with the other features of the blade 14. The tip transitional surface 22 may have a different profile at different chord positions of the blade 14.

The blade tip profile can be truncated by the outer radius R of the rotor to provide tip clearance control.

In the embodiment shown, the leading edge tip 25 and trailing edge tip 26 are each defined by a sweep of the blade profile, formed by the tip transitional surfaces 22 and side transitional surface 21, through an arc guided by a spline coincident with the original leading edge 15 or trailing edge 16 (i.e. without the tangentially extending portion 20). The leading edge tip 25 and trailing edge tip 26 may also be substantially defined as an arc of a circle or a quadratic or higher order equation. In an alternate embodiment, the leading edge tip 25 and trailing edge tip 26 are aligned with the remainder of the leading edge 15 and trailing edge 16, respectively.

Figure 5:
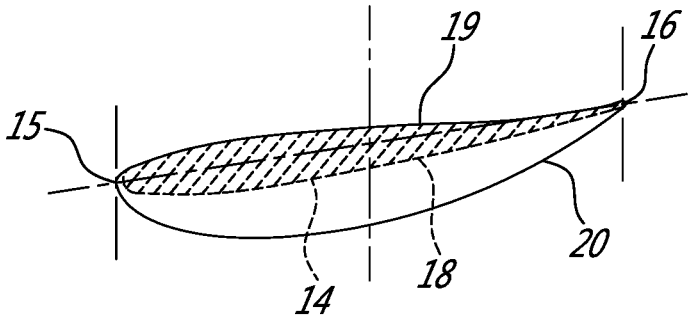
FIG. 5 is a view similar to FIG. 4 of a compressor blade in accordance with another particular embodiment, with a tip extension on the pressure side surface only.

FIG. 5 shows a blade in accordance with another embodiment, where the suction side surface 18 of the airfoil includes a tip extension 20 while the pressure side surface 19 does not. In this embodiment, a side transitional surface 21 is defined on one side of the airfoil 14 only. The tip extension 20 extends over the full length of the chord of the airfoil 14, i.e. the tip extension 20 has an axial dimension equal to the chord length (i.e. length between the leading edge 15 and trailing edge 16).

In an alternate embodiment which is not shown, the pressure side surface 19 of the airfoil includes a tip extension 20 while the suction side surface 18 does not.

Figure 6:
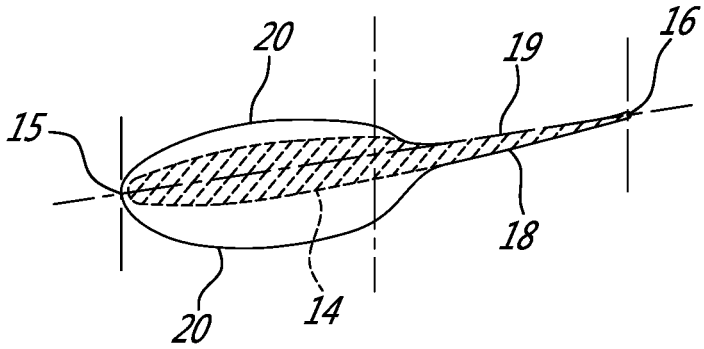
FIG. 6 is a view similar to FIG. 4 of a compressor blade in accordance with a further particular embodiment, with a tip extension along only a leading edge portion of the chord.

FIG. 6 shows a blade in accordance with another embodiment, where the tip extensions 20 are disposed only on a leading edge portion of the chord, while the trailing edge portion of the chord is free of any such tangentially projecting tip extensions. The tip extensions 20 thus have an axial dimension that is less than the chord length. In one possible example, the tip extension(s) 20 axially extends along a length approximately half of the total chord length. In another possible example, the tip extension(s) 20 axially extends a length approximately one third of the total chord length.

Figure 8:
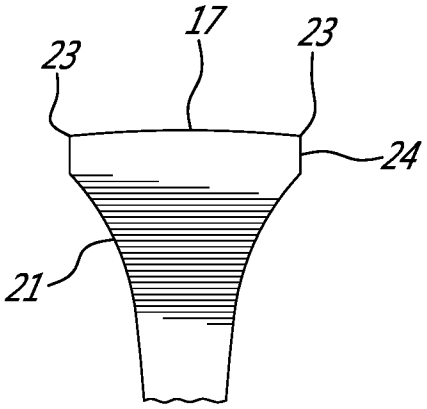
FIGS. 7 and 8 are cross-sectional views similar to FIG. 3 showing other embodiments with tip extensions having alternate profiles.
Figure 7:
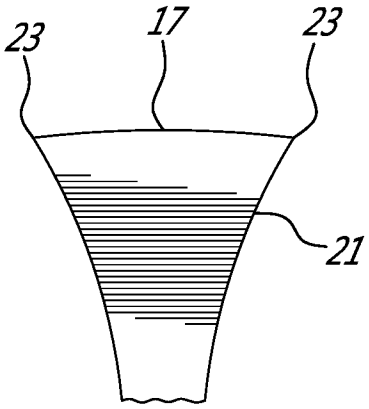

FIGS. 7-8 show different embodiments where a sharp tip edge 23 is defined on each side of the tip 17. As above, the side transitional surface 21 may be substantially defined as a curve extending tangentially with the surface of the airfoil 14 and corresponding to an arc of a circle or a quadratic or higher order equation. The tip transitional surface 22 is however omitted. In the embodiment of FIG. 7, the side transitional surface 21 extends up to the tip of the blade. In the embodiments of FIG. 8, the tip transitional surface 22 is replaced by a radial planar surface 24 with which the side transitional surface 21 intersects. The radial planar surface 24 may help direct air flow and control vortex formation.

Although the blades have been shown as straight, the above described tip profiles can also be applied to blades having a camber and/or a leaned profile, i.e. a curve along the chord and/or along the length.

In all of the embodiments described above, the addition of the tangentially extending tip extension(s) 20 may help in reducing tip leakage of air, which may increase compressor efficiency. The tip extension(s) 20 may also direct air flow to reduce vortex formation at the tip 17, which may also increase efficiency. The tip extension(s) may also provide a benefit to surge margin. The added mass of the tip extension (s) 20 may further increase blade durability and resistance to foreign object damage at the tip 17. Further, the added mass can be selected to change the fundamental vibratory modes of the blade, for example to remove vibratory modes from the running range of the compressor. Accordingly, the amplitude of vibration may be dampened and stress results may be lowered.

Although the tip extension(s) 20 have generally been described herein with particular reference to the airfoil of an axial compressor blade, it is to be understood that the present invention may also be employed on a turbine blade airfoil or on a stator vane airfoil.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. An airfoil for a gas turbine engine, the airfoil comprising:

an airfoil body having a suction side surface and a pressure side surface extending between a root and a tip, and a chord defined between a leading edge and a trailing edge, and a radial direction being defined from the root to the tip, the root defining a root axis extending axially therethrough and a plane perpendicular to the root axis; and a tip extension disposed at the tip of the airfoil body, the tip extension extending from one or both of the suction side surface and the pressure side surface and defining a tip thickness that is larger than a true thickness of the airfoil body, the true thickness defined within said plane and extending transversely to the chord around a midpoint thereof, the true thickness measured radially inward of the tip extension, the tip extension including a side transitional surface forming a curve extending tangentially from said one or both of the suction side surface and the pressure side surface, the tip thickness increasing over a radial dimension in said plane that is at least 2 times the true thickness.

2. The airfoil according to claim 1, wherein the radial dimension is between 2 to 5 times the true thickness.

3. The airfoil according to claim 1, wherein the curve of the side transitional surface corresponds to an arc of a circle, a quadratic equation, or an equation of higher degree than a quadratic equation.

4. The airfoil according to claim 1, wherein the tip extension is provided on both the suction side surface and the pressure side surface.

5. The airfoil according to claim 1, wherein each tip extension includes a curved tip transitional surface extending between the tip and the side transitional surface, the tip transitional surface being substantially defined along a curve extending tangentially to the side transitional surface and corresponding to an arc of circle, a quadratic equation, or an equation of higher degree than a quadratic equation.

6. The airfoil according to claim 1, wherein each tip extension includes a radially extending surface interconnecting the side transitional surface and the tip.

7. The airfoil according to claim 1, wherein the side transitional surface extends up to the tip and forms an edge at an intersection therewith.

8. The airfoil according to claim 1, wherein the tip extension has a length defined along the chord that is less than or equal to a length of the chord.

9. A compressor rotor blade having the airfoil according to claim 1.

10. A turbine rotor blade having the airfoil according to claim 1.

11. A stator vane having the airfoil according to claim 1.

12. The airfoil according to claim 1, wherein one or both of the leading edge and the trailing edge is substantially defined as a curve corresponding to an arc of a circle, a quadratic equation, or an equation of higher degree than a quadratic equation at the tip.

13. A rotor for an axial compressor of a gas turbine engine, comprising:

a hub adapted to be mounted to a shaft for rotation about a longitudinal axis of the gas turbine engine; and a plurality of blades connected to the hub and projecting radially therefrom, each of the blades having:

an airfoil portion extending radially outward from the hub to a tip, the airfoil having a leading edge, a trailing edge, and a chord defined between the leading edge and the trailing edge, the airfoil defining a suction side surface on one side thereof and a pressure side surface on another, and a radial direction being defined from the hub to the tip, the hub defining a hub axis extending axially therethrough and a plane perpendicular to the hub axis; and a tip extension extending from the suction side surface and/or the pressure side surface adjacent the tip and defining a thickness at the tip larger than a true thickness of the airfoil, the true thickness lying in the plane and being defined transversely to the chord around a midpoint thereof and between the hub and the tip extension, the tip extension including a side transitional surface substantially defined along a curve extending tangentially from the suction side surface and/or the pressure side surface, the tip extension increasing in thickness over a portion of the airfoil having a radial dimension greater than or equal to 2 times the true thickness, the radial dimension lying in the plane.

14. The rotor according to claim 13, wherein the curve along which the side transitional surface is substantially defined corresponds to an arc of a circle, a quadratic equation, or an equation of higher degree than a quadratic equation.

15. The rotor according to claim 13, wherein the tip extension is provided on both the suction side surface and the pressure side surface.

16. The rotor according to claim 13, wherein each tip extension includes a tip transitional surface extending between the tip and the side transitional surface, the tip transitional surface being substantially defined along a curve extending tangentially to the side transitional surface and corresponding to an arc of a circle, a quadratic equation, or an equation of higher degree than a quadratic equation.

17. The rotor according to claim 13, wherein each tip extension includes a radially extending surface interconnecting the side transitional surface and the tip.

18. The rotor according to claim 13, wherein the side transitional surface extends up to the tip and forms an edge at an intersection therewith.

19. The rotor according to claim 13, wherein the tip extension has a length defined along the chord substantially equal to a length of the chord.

20. A gas turbine engine comprising a compressor section, a combustor, and a turbine section, a rotor of one or both of the compressor section and the turbine section including:

a hub mounted to a shaft for rotation about a longitudinal axis of the gas turbine engine; and a plurality of blades connected to the hub and projecting radially therefrom, each of the blades having:

an airfoil portion extending radially outward from the hub to a tip, the airfoil having a leading edge, a trailing edge, and a chord defined between the leading edge and the trailing edge, the airfoil defining a suction side surface on one side thereof and a pressure side surface on another, wherein a radial direction is defined from the hub to the tip, the hub defining a hub axis and a plane perpendicular to the hub axis; and a tip extension extending from the suction side surface and/or the pressure side surface adjacent the tip, the tip extension having a tip thickness greater than a true thickness of the airfoil measured in the plane and transverse to the chord around a midpoint thereof, the true thickness defined radially inward of the tip extension, the tip extension including a side transitional surface substantially defined along a curve extending tangentially from the suction side surface and/or the pressure side surface, the tip thickness increasing over a portion of the airfoil having a radial dimension that is greater than or equal to 2 times the true thickness, the radial dimension lying the plane.

* * * * *